United States Patent [19]

Mann

[11] 4,210,541

[45] Jul. 1, 1980

[54] STABILIZED HYDRAULIC FLUID COMPOSITION

[75] Inventor: James T. Mann, Plum Borough, Pa.

[73] Assignee: Gulf Research & Development Company, Pittsburgh, Pa.

[21] Appl. No.: 963,933

[22] Filed: Nov. 27, 1978

[51] Int. Cl.[2] ..... C10M 1/48

[52] U.S. Cl. ..... 252/32.7 E; 252/33.4; 252/78.5

[58] Field of Search ..... 252/32.7 E, 33.4, 78.5

[56] References Cited

U.S. PATENT DOCUMENTS

| | | | |
|---|---|---|---|
| 2,369,632 | 2/1945 | Cook et al. | 252/32.7 E X |
| 2,710,842 | 6/1955 | Heisig et al. | 252/32.7 E X |
| 3,390,081 | 6/1968 | Floeck | 252/32.7 E |
| 3,627,681 | 12/1971 | Chandler | 252/32.7 E |
| 3,652,410 | 3/1972 | Hollinghurst et al. | 252/32.7 E |
| 3,763,244 | 10/1973 | Shubkin | 252/59 X |
| 3,796,662 | 3/1974 | Lyle et al. | 252/32.7 E |

*Primary Examiner*—Andrew Metz

[57] ABSTRACT

Mineral oil or synthetic hydrocarbon base hydraulic fluids containing a zinc bis(dialkyldithiophosphate) as an antiwear agent are stabilized against degradation at elevated operating temperatures by the incorporation in the hydraulic fluid of an appropriate Group I or Group II metal dialkylnaphthalene sulfonate and a fatty acid imidazoline. For example, a hydraulic fluid containing a zinc bis(dialkyldithiophosphate) is stabilized by the presence of a minor amount of zinc dinonylnaphthalene sulfonate and a tallow fatty acid imidazoline.

5 Claims, No Drawings

STABILIZED HYDRAULIC FLUID COMPOSITION

SUMMARY OF THE INVENTION

This invention relates to mineral oil base or synthetic hydrocarbon base hydraulic fluids which contain a zinc bis(dialkyldithiophosphate) as an antiwear agent, and more particularly, it relates to the use of a minor amount of a Group I or Group II metal dialkylnaphthalene sulfonate together with a minor amount of a fatty acid imidazoline in hydraulic fluids containing a zinc bis(-dialkyldithiophosphate) in order to retard the thermal decomposition of the zinc bis(dialkyldithiophosphate) and to minimize sludge formation and metal corrosion resulting from the thermal decomposition products.

DETAILED DESCRIPTION OF THE INVENTION

Hydraulic systems are apparatus for transmitting force over a distance through the agency of a fluid—the hydraulic fluid. This hydraulic fluid not only functions in power transmission but it also must lubricate the moving parts and must seal the closely fitting parts. Additionally, it should resist chemical breakdown, it should not cause rust or corrosion and it should resist foaming. The hydraulic fluid being the heart and most vital part of the system, is the primary recipient of the excessive and variable demands on the system such as shock, overload and high temperatures. As a result the great preponderance of hydraulic system failures directly relate to the hydraulic fluid. And in recent years with expanding uses and more rigorous applications, there is an ever increasing potential for fluid failure.

Mineral oil base hydraulic fluids fortified with appropriate additives have been most commonly used in hydraulic systems. The additives serve to better adapt the oil to this use and to extend its useful life in the hydraulic system. One additive in general use which functions well as an antiwear and antirust agent is a zinc bis(dialkyldithiophosphate). However, these zinc bis(dialkyldithiophosphate)s tend to break down in the more rigorous applications. The higher pumping pressures required by more demanding uses cause a temperature buildup in the fluid particularly at the pump and valves and at other critical points which become the center of hot spots in the system.

It has been determined that the zinc bis(dialkyldithiophosphate) additive begins to exhibit significant decomposition when the fluid temperature reaches a level of about 200° F. (93.3° C.). This decomposition results in the formation of insoluble sludge sediments and deposits in the hydraulic fluid which can build up to a substantial volume and lead to excessive wear and plugging of filters and constriction of orifices. The decomposition also results in the formation of acidic decomposition products in the sludge which actively attack the metals in the system, particularly the copper in the bearing alloys, seals and other parts. The resulting corrosion will eventually lead to the failure of the hydraulic system.

I have discovered that a minor amount of an appropriate Group I or Group II metal dialkylnaphthalene sulfonate together with a minor amount of a fatty acid imidazoline will stabilize the hydraulic fluid and the zinc bis(dialkyldithiophosphate) antiwear agent at temperatures in the hydraulic fluid up to about 300° F. (148.9° C.), and preferably up to about 275° F. (135° C.)

and at pressures up to about 3,000 psi. (20.7 MPa). Since significant decomposition begins at about 200° F. (93.3° C.), the combined use of this metal dialkylnaphthalene sulfonate and the fatty acid imidazoline is particularly desirable when fluid operating temperatures of at least about 175°-200° F. (79.4°-93.3° C.) are anticipated.

The metal dialkylnaphthalene sulfonate of the stabilizer composition has a sulfonate group attached to one ring of the naphthalene nucleus and an alkyl group attached to each ring. Each alkyl group can independently contain from about six to about twenty carbon atoms, but it is preferred that they contain from about eight to twelve carbon atoms. The dialkylnaphthalene sulfonate group is attached to the metal through the sulfonate group. In the case of monovalent metals, one dialkylnaphthalene sulfonate group is attached to each metal atom while there are two groups attached to each atom of a divalent metal. Calcium, barium, sodium, magnesium and lithium can be used as the metal, but I prefer to use zinc as the metal in this sulfonate stabilizer. The metal dialkylnaphthalene sulfonate exhibits a stabilizing effect in the hydraulic fluid when it is used in an amount of between about 0.01 and about one volume percent, and preferably between about 0.1 and about 0.5 percent.

The expression fatty acid imidazoline as used herein is defined by the general formula

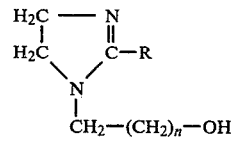

wherein n is an integer from 0 to 3, preferably 1, and R is selected from alkyl, alkenyl, alkadienyl, alkatrienyl having from about 10 to about 30 carbon atoms, preferably from about 12 to about 18 carbon atoms. Since the R group is derived from a fatty acid in a method for preparing the compound, the preferred R groups are those derived from the more common, naturally occurring fatty acids including lauric acid, myristic acid, palmitic acid, stearic acid, palmitoleic acid, oleic acid, linoleic acid, linolenic acid, eleostearic acid and the like. The compound with n equal to 1 and prepared from stearic acid is 4,5-dihydro-2-octadecyl-1H-imidazole-1-ethanol.

Generally, however, the fatty acid imidazoline will be a mixture of compounds because the naturally occurring fatty acids are most commonly available as mixtures. For example, a mixture of stearic acid, palmitic acid and oleic acid is obtained from tallow, therefore, the fatty acid imidazoline prepared from tallow fatty acids is a mixture of compounds in which R is hexadecyl, octadecyl and 9-octadecenyl. This fatty acid imidazoline exhibits a stabilizing effect in the hydraulic fluid composition when it is used in an amount of between about 0.01 to about one weight percent and preferably between about 0.05 to about 0.5 weight percent.

In general, the zinc bis(dialkyldithiophosphate) antiwear agent is used in the hydraulic fluid in an amount between about 0.1 to about 2.0 volume percent, and preferably between about 0.2 and about 1.0 percent. The alkyl groups in this compound will generally have between about four and about twelve carbon atoms, and preferably they will have between about seven and about nine carbon atoms.

A mineral oil is generally used as the base fluid in the hydraulic fluid in an amount comprising from about 90 to 99.9 percent of the total hydraulic fluid. This mineral oil is preferably highly refined to remove any nonhydrocarbon components which could lead to corrosion, deposits, and the like. The 100° F. (37.8° C.) viscosity of the base oil useful in the hydraulic fluids will range between about 100 SUS (20.6 cs.) ($2.06\times10^{-5}m^2/s$) and about 1,000 SUS (215 cs.) ($2.15\times10^{-4}m^2/s$).

A suitable synthetic hydrocarbon oil can also be used as the base fluid, such as, for example, an alpha-olefin oligomer. These oligomers are currently being produced primarily for use as lubricants in automotive engines and in jet aircraft engines. These alpha-olefin oligomers are generally prepared from 1-decene, but any alpha-olefin or mixture of alpha-olefins from 1-butene to 1-dodecene can be used.

The hydraulic fluid can also contain other additives such as antioxidants, antifoamers, V. I. improvers, vapor phase inhibitors, pour point depressants, demulsibility improvers, and the like. Although the zinc bis(-dialkyldithiophosphate) provides some antioxidation protection in addition to its antiwear and antirust properties, it may be desirable to add an additional antioxidant such as di-t.butyl-p-cresol to the fluid.

DESCRIPTION OF PREFERRED EMBODIMENTS

In the following heat stability tests, the testing procedure developed by the Cincinnati Milacron Company, Cincinnati, Ohio was used. This test procedure utilizes two clean weighed rods of 0.25 inch diameter and three inches long, one of 99.9 percent copper and the other, one percent carbon steel. The rods are submerged in 200 cc. of the test oil in contact with each other and the oil and test rods are heated to 135° C. After 168 hours (seven days) at 135° C., the rods are removed from the oil and loose sludge is squeegeed back into the oil with a plastic policeman. At this point the copper rod is visually evaluated and rated as to stain and discoloration by ASTM D130.

The copper rod is washed with acetone to remove oil before being weighed to determine the total weight of the rod plus sludge deposit. It is then subjected to a ten percent solution of potassium cyanide for one minute to strip the sludge deposit from the rod and is then sequentially washed in distilled water and acetone before being weighed again. The difference in the weight of this cleansed rod and the intial rod weight is the copper loss. The difference in the weight of this cleansed rod and the sludge deposit.

The oil is filtered through a filter paper and the residue on the filter paper is washed with naphtha to free it of oil. The weight of this residue is the filter paper sludge. A portion of the oil filtrate is filtered through an eight micron millipore filter pad and this residue is also washed free of oil with naphtha. The weight of this residue is the millipore filter sludge. The total sludge in milligrams per 100 milliliters of oil is determined from the weight of the sludge deposit, the filter paper sludge and the millipore filter sludge, each adjusted to mg. per 100 ml. of oil.

The stain and discoloration evaluation under ASTM D130 is the result of a visual comparison with 12 preprepared strips of increasing stain and discoloration which are available as standards for making the comparison. Group 1 represents slight tarnish, group 2 represents moderate tarnish, group 3 represents dark tarnish and group 4 represents corrosion (black). Increasing discoloration within each group, indicated by color changes, is represented by the letters A, B, etc. Therefore, a matching with the first strip gives a 1A rating, a matching with the second strip gives a 1B rating, a matching with the fourth strip gives a 2B rating, a matching with the eighth strip gives a 3A rating, and a matching with the twelfth strip gives a 4C rating, which is the most severe rating under this procedure.

The base oil that was used in the test was a solvent refined neutral mineral oil having a 100° F. (37.8° C.) viscosity of 200 SUS (43.2 cs.) ($4.32\times10^{-5}m^2/s$). It contained 0.30 volume percent of a commercial pour point depressant (Hitec E672, Edwin Cooper Co., St. Louis, Mo.), 0.20 weight percent added of di-t.butyl-p-cresol and one ppm. of a polymerized dimethylsiloxane as an antifoam agent. Several portions of the hydraulic fluid were formulated with 0.50 volume percent of zinc bis(di-2-ethylhexyldithiophosphate) antiwear agent and one portion was tested without stabilizer. The several portions were separately tested with two metal dinonylnaphthalene sulfonate stabilizers with and without a fatty acid imidazoline. The fatty acid imidazoline was prepared from tallow fatty acids and contained ethanol in the 1-position. The following table identifies the metal in the sulfonate stabilizer and the amount of each stabilizer that was used as well as the results of the tests.

| Sulfonate | | Imidazoline | Sludge | Cu loss | ASTM |
|---|---|---|---|---|---|
| metal | vol. % | wt. % | mg./100 ml. | mg. | D130 |
| — | — | — | 253.0 | 12.4 | 4C |
| Ca | 0.30 | — | 161.3 | 11.4 | 4C |
| Ca | 0.30 | 0.05 | 56.6 | 0.50 | 3A |
| Zn | 0.20 | — | 13.1 | 4.7 | 2B |
| Zn | 0.20 | 0.05 | 5.05 | 1.8 | 1B |

It is noted from this data that the zinc dinonylnaphthalene sulfonate effects a substantial decrease in the sludge formation and copper loss and a substantial improvement in stain and discoloration. The benefits from using the metal dinonylnaphthalene sulfonates are shown to be further increased by the concurrent use of a fatty acid imidazoline.

It is to be understood that the above disclosure is by way of specific example and that numerous modifications and variations are available to those of ordinary skill in the art without departing from the true spirit and scope of the invention.

I claim:

1. A hydraulic fluid stabilized against thermal degradation comprising a base oil having a 100° F. (37.8° C.) viscosity of between about 100 SUS (20.6 cs.) and about 1,000 SUS (215 cs.) and selected from highly refined mineral oils, alpha-olefin oligomers and mixtures thereof; from about 0.1 to about 2.0 volume percent of a zinc bis(dialkyldithiophosphate) in which the alkyl groups have between about four and about twelve carbon atoms; from about 0.01 to about 1.0 volume percent of a metal dialkylnaphthalene sulfonate in which the metal is selected from lithium, sodium, magnesium, calcium, barium and zinc and the alkyl groups contain between about six and about twenty carbon atoms; and from about 0.01 to about 1.0 weight percent of a composition having the general formula

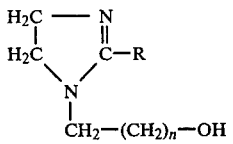

where n is an integer selected from 0, 1, 2 and 3 and R is selected from alkyl, alkenyl, alkadienyl, alkatrienyl, and mixtures thereof having from about ten to about thirty carbon atoms.

2. A hydraulic fluid stabilized against thermal degradation comprising a base oil having a 100° F. (37.8° C.) viscosity of between about 100 SUS (20.6 cs.) and about 1,000 SUS (215 cs.) and selected from highly refined mineral oils, alpha-olefin oligomers and mixtures thereof; from about 0.1 to about 2.0 volume percent of a zinc bis(dialkyldithiophosphate) in which the alkyl groups have between about four and about twelve carbon atoms; from about 0.01 to about 1.0 volume percent of a zinc dialkylnaphthalene sulfonate in which the alkyl groups contain between about six and about twenty carbon atoms, and from about 0.01 to about 1.0 weight percent of a composition having the general formula

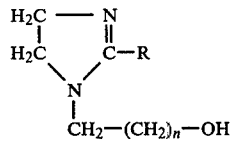

where n is an integer selected from 0, 1, 2 and 3 and R is selected from alkyl, alkenyl, alkadienyl, alkatrienyl, and mixtures thereof having from about ten to about thirty carbon atoms.

3. A hydraulic fluid stabilized against thermal degradation in accordance with claims 1 or 2 in which the alkyl groups in the zinc bis(dialkyldithiophosphate) compound have between about seven and about nine carbon atoms.

4. A hydraulic fluid stabilized against thermal degradation in accordance with claims 1 or 2 in which alkyl groups in the metal dialkylnaphthalene sulfonate have between about eight and about twelve carbon atoms, R has between about 12 and about 18 carbon atoms and n is 1.

5. A hydraulic fluid stabilized against thermal degradation in accordance with claims 1 or 2 in which there is between about 0.05 and about 0.5 volume percent of the metal dialkylnaphthalene sulfonate.

* * * * *

UNITED STATES PATENT OFFICE
CERTIFICATE OF CORRECTION

Patent No. 4,210,541 Dated July 1, 1980

Inventor(s) James T. Mann

It is certified that error appears in the above-identified patent and that said Letters Patent are hereby corrected as shown below:

Col. 3, line 53, before "sludge" insert --weight obtained prior to cleansing is the weight of the--.

Signed and Sealed this

*Seventh* Day of *October 1980*

[SEAL]

*Attest:*

SIDNEY A. DIAMOND

*Attesting Officer*

*Commissioner of Patents and Trademarks*